United States Patent [19]

Redding et al.

[11] 4,059,184

[45] Nov. 22, 1977

[54] SINGLE PRINT ELEMENT SELECTION APPARATUS WITH MULTIPLE SELECTION INHIBITING MEANS

[75] Inventors: Robert Caldwell Redding, Versailles; Joe Larry Vaughan, Lexington, both of Ky.

[73] Assignee: International Business Machines Corporation, Armonk, N.Y.

[21] Appl. No.: 756,308

[22] Filed: Jan. 3, 1977

[51] Int. Cl.[2] ..... B41J 1/60

[52] U.S. Cl. ..... 197/18; 197/55

[58] Field of Search ..... 74/57; 101/93.17; 178/34; 197/18, 52, 55, 107

[56] References Cited

U.S. PATENT DOCUMENTS

| | | | |
|---|---|---|---|
| 3,021,937 | 2/1962 | Seymour | 197/107 |
| 3,536,178 | 10/1970 | Breidenbach | 197/107 |
| 3,892,304 | 7/1975 | Shakib | 197/55 X |

*Primary Examiner*—Paul T. Sewell

*Attorney, Agent, or Firm*—William J. Dick

[57] ABSTRACT

Disclosed is a selection apparatus for a printer of the single element type wherein the single print element is carried by a print carrier. The carrier includes at least one cylinder having a plurality of axially spaced apart camming surfaces thereon, the cylinder mounted for both axial and rotational movement. Each of a plurality of selection pins is engageable with one of the camming surfaces to impart a predetermined but differing axial motion of the cylinder upon engagement of one of the pins with its associated camming surfaces and rotation of the cylinder. Pin selection apparatus permits engagement of selected ones of the pins with an associated camming surface, the pin selection apparatus including pin motion inhibiting apparatus associated therewith so as to inhibit multiplc pin selection with associated camming surfaces to thereby prevent any attempt at differential camming of the cylinder along its axis by more than one pin engaging more than one camming surface.

10 Claims, 7 Drawing Figures

ROTATE SELECTION CODE

| TO SELECT ROTATE PIN NUMBER | ACTUATE MAGNET/SLIDE NUMBER |
|---|---|
| 0 | NONE |
| 1 | 2B AND 3B |
| 2 | 1B AND 3B |
| 3 | 1B AND 2B |
| 4 | 3B |
| 5 | 2B |
| 6 | 1B |

TILT SELECT CODE

| TO SELECT TILT PIN NUMBER | ACTUATE MAGNET/SLIDE NUMBER |
|---|---|
| 0 | NONE |
| 1' | 1B' AND 2B' |
| 2' | 2B' |
| 3' | 1B' |

SINGLE PRINT ELEMENT SELECTION APPARATUS WITH MULTIPLE SELECTION INHIBITING MEANS

SUMMARY OF THE INVENTION AND STATE OF THE PRIOR ART

The present invention relates to single element typewriters and printers, and more specifically relates to a single print element print carrier with self contained selection function and more specifically an improvement in the selection apparatus taught and shown in U.S. Pat. No. 3,892,304, issued on July 1, 1975 to the assignee of the present invention.

Single element typewriters and printers are common in the prior art. As explained previously in the above identified U.S. Pat. No. 3,892,304, which is herein incorporated by reference, a single element typewriter having a fixed carriage requires a moveable print carrier with multiple interconnections between the keyboard and the carrier. The interconnection technique prior to the U.S. Pat. No. 3,892,304 has primarily been through pulleys, tapes, cables and the like, which decode through mechanical linkage, a keyboard input and transmit that information to the print carrier by means of differential links of tape or cord which are taken up through the movement of the pulleys. In this manner the type element is caused to rotate and tilt the appropriate amount to position the desired character at the print point. Obviously, the extensive mechanical interconnections between the main frame of the typewriter and the rotate and tilt apparatus on the print carrier requires a highly accurate manufacturing process and thus side frame or power frame for the typewriter in addition to exceedingly accurate positioning of components and the like on the power frame. The tight tolerance requirements obviously raise the cost of manufacturing such an apparatus and, in addition, require extensive adjustments to make a typewriter or printer function in accordance with the way it is supposed to function. Additionally, during the manufacturing process, it is essential to build up each power frame piece by piece to produce the printer and then interconnect the appropriate decoding linkages and mechanisms with the print carrier. Obviously each stage introduces new places for the possibility of this adjustment of the various portions of the machine.

However, even with the print carrier with the self-contained selection function described in the above identified United States patent, a serious problem relative to the possibility of catastrophic failure resulting from the simultaneous selection of more than one pin in a groove or camming surface in the cylinder or barrel cam in the selection mechanism is presented. Inasmuch as the pins are fixed, and the rotation of the cylinder or barrel cam relative to the fixed pin causes axial displacement of the barrel cam, each groove having a different axial displacement than every other groove, then it is easy to imagine that the selection of more than one pin into more than one groove could effect a jamming (at the very least) and breakage or break-up at best of the selection mechanism.

In view of the above, it is a principle object of the present invention to provide a selection apparatus for a single element typewriter or printer with inhibiting means associated with the selection apparatus to prevent multiple simultaneous selection.

Still another object of the present invention is to provide an improvement in apparatus of the type described in U.S. Pat. No. 3,892,304.

Other objects and a more complete understanding of the invention may be had by referring to the following specification and claims taking in conjunction with the accompanying drawing in which:

Figures 1, 4A, 4B:
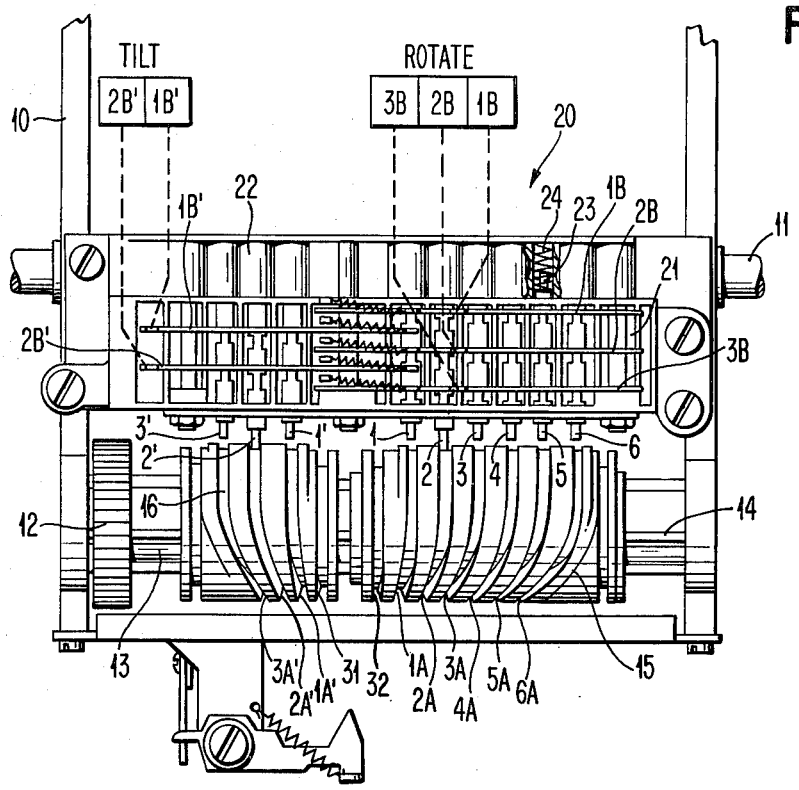
FIG. 1 is a fragmentary plan view of a single element typewriter selection mechanism incorporating apparatus constructed in accordance with the present invention.
Figure 2:
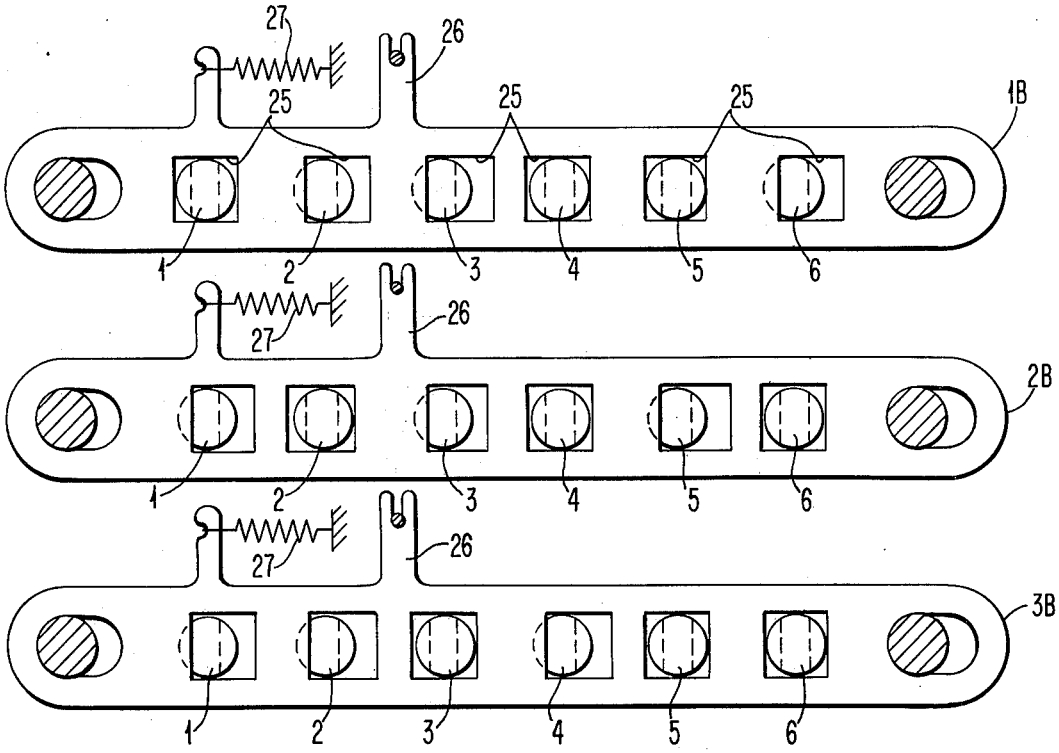
FIG. 2 is an enlarged fragmentary sectional view of a portion of the apparatus illustrated in FIG. 1 but broken out of its position and rotated 90° to best illustrate the operation of the apparatus.
Figure 3:
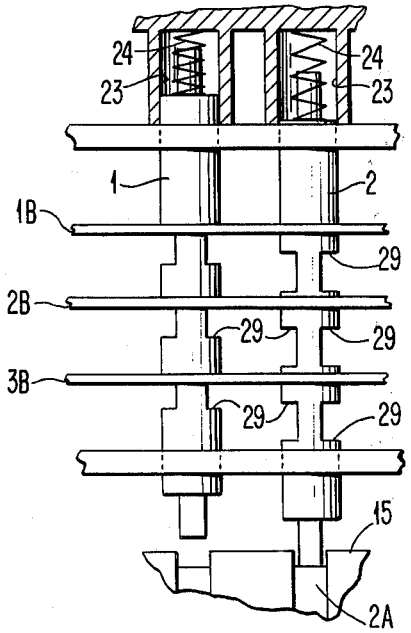
FIG. 3 is an enlarged fragmentary sectional view taken in plan and illustrating the position of a portion of the selection apparatus illustrated in FIGS. 1 and 2.
Figure 5:
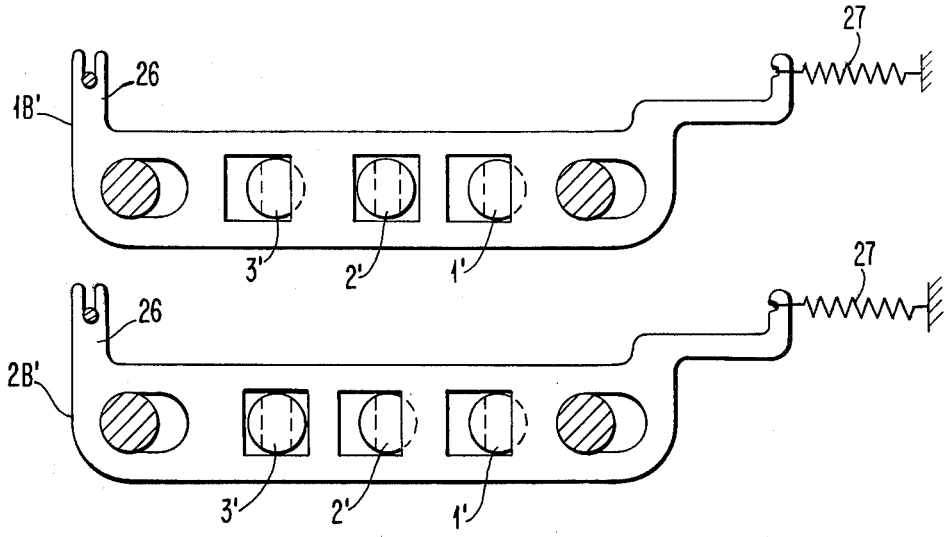
Figure 6:
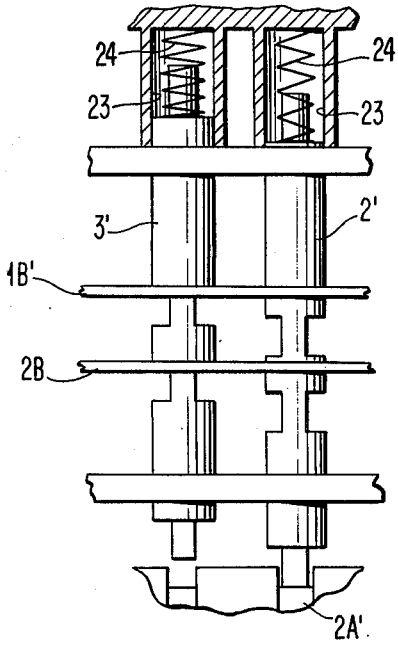

FIGS. 4*a* and 4*b* are charts indicating respectively the rotation selection code and the tilt selection code for a single element typewriter utilizing the apparatus illustrated in FIGS. 1–3, 5 and 6;

FIG. 5 is a view similar to FIG. 2 except illustrating a portion of the apparatus utilized to select the tilt of a single element print head; and FIG. 6 is an enlarged fragmentary sectional view similar to FIG. 3 but taken from FIG. 5 and illustrating the position of portions of the selection apparatus for tilting a single element print head.

Referring now to the drawings, and especially FIG. 1 thereof, a carrier frame 10 supports selection apparatus for a printer of the single element type (not shown). The entire structure of the single element printer or typewriter referred to herein is described and shown in U.S. Pat. No. 3,892,304, issued on July 1, 1975 to Iraj D. Shakib and assigned to International Business Machines Corporation, said issued patent being incorporated herein by reference.

Suffice at this point, that the only mechanism illustrated and described herein is that portion of the apparatus or machine illustrated in U.S. Pat. No. 3,892,304 which has been improved.

As shown in the aforesaid United States patent, and especially FIGS. 2, 4, 8 and 9 thereof, the single element printing head, which is typical of the IBM Selectric typewriter, is coded by keyboard input to effect both a rotation and a tilting of the printhead in order to imprint upon paper held in the platen of the machine. The amount of rotation as well as the amount of tilt in the machine described in the patent is controlled by pins or the like impinging upon grooves in a cylinder or barrel cam, each of the grooves acting as a cam track or channel having a different or differing throw from the adjacent track or channel. The barrel or cylinder cam is mounted for rotation and translation on a splined shaft which is mounted on the carrier frame 10. Cam followers on the cylindrical cams follow the axial movement of the cam and through suitable linkages effect rotation and/or tilt to the printhead.

It was discovered that if more than one pin engaged a selection groove, i.e., multiple pins in multiple grooves, as the cylindrical cam rotated, there would be an attempt at differential camming of the cylinder along its axis causing at least jamming of the selection apparatus or in worst cases causing breakage of either the pins, cam, or associated gearing for driving the cylindrical cam or the shaft itself. To this end, the mechanism is modified by adding pin motion inhibiting means associated with the pin selection means to inhibit any attempt at differential camming of the cylinder along the axis of the cylinder by more than one pin engaging more than one camming surface means.

Turning now to FIG. 1, the carrier frame 10 houses and supports the selection apparatus 20 by which the printing element is caused to rotate and tilt to position the printing element in the desired position for imparting a letter or character upon paper or other medium held by the platen. As shown, the carrier frame includes a printing shaft 11, which through suitable gearing (not shown) effects rotation of a cam shaft gear 12 which is connected to a cam shaft 13 having splines 14 thereon and serving to mount for rotation thereon a cylindrical rotate selection cam 15 and a cylindrical tilt selection cam 16.

As shown best in FIG. 1, each of the cams 15 and 16 includes a plurality of axially spaced apart camming means or camming surface means, in the illustrated instance selection grooves 1A–6A associated with rotation selection cam 15, and selection grooves 1A′ – 3A′ associated with tilt selection cam 16.

In order to effect axial translation of the appropriate cylindrical cam or cylinder 15 and 16, pins 1–6 are designated as being in alignment with the selection grooves 1A–6A respectively on the rotate selection cam 15, while pins 1′ – 3′ are shown to be in alignment with selection channels or grooves 1A′ – 3A′. The pins, as illustrated, are mounted in a frame 21 which is bolted to the carrier frame 10, the frame including a housing section 22 having bores 23 therein for capturing a biasing spring 24 which is in alignment with the after end of the pins. As shown best in FIG. 1, all of the pins not selected are recessed against the biasing spring and are not in engagement with the selection grooves of their associated selection cam.

In order to effect propulsion of a selected pin into engagement with an associated camming means or groove, pin selection means are provided and act in conjunction with pin motion inhibiting means to inhibit multiple pin selection with the associated camming means to thereby prevent any attempts at differential camming of the cylinder along its axis by more than one pin engaging more than one camming means. To this end, the assembly 21 includes a plurality of slides; Slides 1B, 2B and 3B being associated with pins 1–6 and selection cam 15, while slides 1B′ and 2B′ are associated respectively with pins 1′ – 3′ and tilt selection cam 16. Each of the slides, as shown best in FIG. 1, are connected as by dotted lines to motive means such as electromagnets which are given the same number as the slide itself so as to facilitate understanding by the reader.

As will become evident from the description given hereinafter, each of the slides is movable between a first and second position and, as best illustrated in FIG. 2, each of the slides 1B–3B and 1B′, 2B′ includes code means thereon, in the illustrated instance for engaging first selected ones of the pins when the slides are in the first position (such as illustrated in FIG. 2 and FIG. 5), and second selected ones of the pins when in the second position, the motive means for the slides being translated through tabs or the like 26 which are connected to the respective electromagnets shown schemematically in FIG. 1. As illustrated, each of the slides is biased as by a spring 27 to maintain the slides in their first or rest position. As shown best in FIGS. 1–3, each of the pins includes grooves 29 which serve, with a properly coded slide, to maintain the pin biased against the biasing spring 24.

As may be seen, for example from FIG. 2 and FIG. 4*a*, if pin 2 is to be propelled into selection groove 2A causing translation of the rotate selection cam 15 along splines 14 of shaft 13, it is necessary to move slides 1B and 3B as by electromagnets 1B and 3B from their first position shown in FIG. 2 to the left against the biasing springs 27 to permit release of pin 2, and permitting that pin to be propelled into groove 2A of rotate selection cam 15. Thus by simply reading the table in FIG. 4A it is a simple matter to see which electromagnets and thus slides associated therewith must be energized to effect selection of which pins. In the same manner, the code set forth in FIG. 4*b* indicates which of the tilt electromagnets 1B′, 2B′ and thus the slides which need be energized and moved from their first position to their second position so as to permit the proper pin movement into the selection groove of the cam.

It should be noted that each of the cams 15 and 16 has its own follower grooves 31 and 32 respectively in which rides the appropriate followers for causing the motions of the print element. However, for purposes of clarification, the followers are not shown but the attention of the readers is directed to FIGS. 8 and 9 of the aforementioned United States patent which illustrates the cam followers for those particular grooves.

Thus the apparatus of the present invention provides a quick and efficient means for allowing pin selection in single element typewriters of the type having cam type selection apparatus, while inhibiting the pins from selecting or moving into a cam and creating the possibility of more than one pin being selected at more than one time.

Although the invention has been described with a certain degree of particularity, it is understood that the present disclosure has been made only by way of example and that numerous changes in the details of construction and the combination and arrangement of parts may be made without departing from the spirit and the scope of the invention as hereinafter claimed:

What is claimed is:

1. A selection apparatus for a printer of the single element type, having a single print element carried by a print carrier, comprising:

at least one cylinder supported for both axial and rotational movement, and having a plurality of axially spaced apart camming surface means thereon to effect differing axial displacement of said cylinder;

a plurality of selection pins, each selectively engageable with one of said camming surface means to impart a predetermined but differing axial motion to said cylinder upon engagement of a selected one of said pins within an associated camming surface means and upon rotation of said cylinder;

pin selection means to effect propulsion of each of said pins into engagement with an associated camming surface means;

and pin motion inhibiting means associated with said pin selection means, said pin motion inhibiting means comprising a plurality of slides having code means therein, said code means comprising means defining a plurality of apertures in said slides, said slides dimensioned to permit passage of pins therethrough, and said pins including recessed portions dimensioned to permit engagement of said aperture defining means in a recessed portion thereby engaging at least some of said pins when said slides are in a first position and at least other of said pins when said slides are in a second position to inhibit multiple pin engagement with their associating camming surface means to thereby prevent more than one pin engaging more than one camming surface means at the same time.

2. A selection apparatus in accordance with claim 1 wherein said camming surface means comprises grooves in the surface of said cylinder.

3. A selection apparatus in accordance with claim 1 including biasing means engageable with each of said pins to urge said pins towards said cylinder.

4. A selection apparatus in accordance with claim 1 including electromagnet means engageable with each of said slides for selectively moving each of said slides.

5. A selection apparatus for a printer of the single element type, having a single print element carried by a print carrier, comprising:

a cam and cam follower, a plurality of cam means on said cam to effect different axial motion of said cam and thus said follower upon engagement of said cam means with a selection pin;

a plurality of selection pins each selectively engageable with one of said cam means to impart said predetermined differing axial motion of the cam upon engagement of selected ones of said pins with an associated cam means and upon rotation of said cylinder;

pin selection means to effect propulsion of each of said pins into engagement with an associated cam means;

pin motion inhibiting means comprising a plurality of slides, and electromagnet engageable with each of said slides, each slide being movable between first and second positions and having code means thereon for engaging first selected ones of said pins when in said first position, and second selected ones of said pins when in said second position, said code means comprising a means defining a plurality of apertures in said slides, said slides dimensioned to permit passage of pins therethrough, and said pins including recessed portions dimensioned to permit engagement of said aperture defining means in said recess, said code means on said slides arranged so that upon movement of at least one of said slides from said first to said second position, the engagement of more than one pin with one of said cam means is inhibited.

6. A selection apparatus in accordance with claim 5 wherein said cam means comprises grooves in the surface of said cam.

7. A selection apparatus in accordance with claim 5 wherein said pin selection means comprises biasing means tending to urge said pins towards said cam.

8. In a selection apparatus for a single element printer, said apparatus comprising:

a cylinder mounted for both rotation and axial translation on a shaft, said cylinder having a plurality of axially spaced apart, circumferentially extending grooves therein, at least some of said grooves being aligned with respective ones of a plurality of pins, means to effect movement of selected ones of said pins so that upon a pin entering its associated groove and upon rotation of said cylinder, said cylinder translates axially on said shaft a predetermined amount, the improvement comprising;

pin selection means including a plurality of slides having means defining a plurality of apertures in each of said slides, and slides dimensioned to permit passage of pins therethrough, and said pins including recessed portions dimensioned to permit engagement of said aperture defining means in said recessed portions, for engaging at least some of said pins when in a first position and at least other of said pins when in a second position, inhibiting multiple pin selection with its associated groove and thereby preventing any attempt at differential camming of said cylinder along its axis by more than one pin engaging more than one groove at the same time.

9. A selection apparatus in accordance with claim 8 wherein said pin selection means includes biasing means tending to urge said pins towards said grooves.

10. A selection apparatus in accordance with claim 9 including electromagnet means engageable with each of said slides for selectively moving each of said slides.

* * * * *